United States Patent [19]

Colli et al.

[11] Patent Number: 4,915,314

[45] Date of Patent: Apr. 10, 1990

[54] DEVICE AND PROCESS FOR THE REGULATION OF THE DRIVE MEANS IN THE WINDING OF THREADS ON TEXTILE MACHINERY

[75] Inventors: Luigi Colli; Roberto Badiali; Nereo Marangone, all of Pordenone, Italy

[73] Assignee: Savio, S.p.A., Pordenone, Italy

[21] Appl. No.: 396,764

[22] Filed: Aug. 22, 1989

Related U.S. Application Data

[63] Continuation of Ser. No. 111,013, Oct. 20, 1987, abandoned.

[30] Foreign Application Priority Data

Oct. 22, 1986 [IT] Italy ..... 22077 A/86

[51] Int. Cl.[4] ..... B65H 54/02

[52] U.S. Cl. ..... 242/18 R; 242/18 DD; 242/18.1; 242/35.5 R; 242/36

[58] Field of Search ..... 242/18 R, 18 DD, 18.1, 242/35.5 R, 36, 49, 45

[56] References Cited

U.S. PATENT DOCUMENTS

| | | | |
|---|---|---|---|
| 4,221,344 | 9/1980 | Lohest | 242/18.1 |
| 4,245,794 | 1/1981 | Hasegawa et al. | 242/45 |
| 4,394,986 | 7/1983 | Hasegawa et al. | 242/18 R |
| 4,487,374 | 12/1984 | Sugioka et al. | 242/18 R X |
| 4,548,366 | 10/1985 | Wirz et al. | 242/18 R X |
| 4,566,642 | 1/1986 | Sommer et al. | 242/18 R |
| 4,685,629 | 8/1987 | Sugioka | 242/18 R |
| 4,715,548 | 12/1987 | Miyake et al. | 242/18 R |

*Primary Examiner*—Stanley N. Gilreath

*Attorney, Agent, or Firm*—Herman, Gibson, Costigan & Hoare

[57] ABSTRACT

A device and a process for the regulation of the drive means which drive the various operating steps of the individual collection station of a winding machine, e.g., an automatic coner machine, wherein each collection station is equipped with a drive source.

More particularly, said device comprises:

a three-phase motor driving the drive roll by means of a positive transmission, such as a toothed belt;

a variable-frequency inverter, which feeds and pilots the drive source, in conformity with the signals coming from a central control unit, which in its turn processes the working parameters coming from the winding station, together with the monitored data coming, in feedback, from the speed monitoring probe-wheel;

a speed monitoring probe-wheel keyed on the drive shaft, capable of measuring the speed and the length of the thread being collected, according to preestablished sequences and operating cycles;

a fully-reversible power circuit capable of making electric power flow both from the power supply distribution system to the drive source, and from this latter to the other drive sources of the operating front; or towards the same power supply distribution system.

8 Claims, 3 Drawing Sheets

DEVICE AND PROCESS FOR THE REGULATION OF THE DRIVE MEANS IN THE WINDING OF THREADS ON TEXTILE MACHINERY

This is a continuation application of Ser. No. 07/111,013, filed Oct. 20, 1987, now abandoned.

The present invention relates to a device and to a process for driving and coordinating the movements of a three-phase drive source which supplies the individual fluted thread-guide roll, through a positive transmission, with acceleration values, braking values, and values of reveral of the revolution direction according to pre-established times carefully selected to achieve an optimum winding.

More particularly, the present invention relates to a variable-frequency inverter which performs the functions of power transducer converting signals coming from a central control unit into electrical power signals suitable to drive the three-phase drive source in the desired way. When the variable-frequency inverter receives the start-up signal, it starts up the drive source with a pre-established and calibratable acceleration slope, and it brings it from zero speed to the steady-state running speed; also the steady-state running speed is pre-established and calibratable.

When the variable-frequency inverter receives the stop signal, it pilots the drive source with a pre-established and calibratable deceleration slope, and brings it from the steady-state running speed to zero speed.

When the variable-frequency inverter receives the revolution-direction-reversing signal, it pilots the drive source, obliging it to precise pre-established and calibratable motion values according to the requirements of the programmed cycle.

The treads have been normally wound by friction for a long time. In this case, the bobbin, or cone, during its winding process, is driven by being kept in contact with a drive roll, which revolves at a constant number of revolutions per minutes. In this case, when the cone is placed into contact with a drive roll, the cone is accelerated up to the peripheral speed of the same roll, which rotates at a constant winding speed.

During the acceleration time of the cone, unavoidingly slippings occur, whose extents depend on the values of the forces developed by contact pressure between the two elements, and on the weight—and hence, on the dimensions—of the cone being formed.

With an arrangement of this type, the cone, as well ast he wound thread, are stressed in a detrimental way, generating faulty lengths of thread, and inaccurate windings, which cause difficulties during the unwinding processes downstream the production process.

In the automatic coner machines with thread cross winding, the roll which drives the cone, and the thread-guide unit constitute a single machine element, which is the fluted drum. During the start-up steps, and during the stop braking steps, the cone frequently undergoes sudden speed changes, which cause disarrangements in turns in the cross winding, due to the too sudden and irregular accelerations, which cause, furthermore, more or less marked slippings, which can easily cause the scorching and sticking of outer fibrils in the threads, due to local overheating. Said stickings cause missed intakes of the cone thread end at the beginning of the knotting cycle, with decreases in the machine efficiency. It is known as well that, in the cross-winding cones from automatic coner machines for thread cross winding, the thread turn disarrangements can easily generate cone formation defects, which lead to difficulties during the unwinding process run in the manufacturing processes downstream the coning.

Therefore, often, when the type and the quality of the winding are unsuitable for the use they are intended for, the cones have to be re-coned, causing excessive costs in the manufacturing process.

The purpose of all of the coning, or re-coning processes is to obtain a thread make-up which gives a minimum of drawbacks during the subsequent manufacturing steps: now then, the cross winding cones must supply these guarantees.

Several contrivances, suitable for overcoming said winding drawbacks have long been known. They have also led to a considerable impmrovement in the quality of the cross-winding bobbins. Nevertheless, from time to time, defects can still possibly occur in thread layers or in thread positions in the cross-winding cone thread make-ups.

In fact, devices and processes are known, which make it possible to gradually start-up the fluted drive roll, by means of a isntallation, with clutch-type drive coupling, between a drive shaft and said drive roll, of an idle pulley made from a non-metallic material, which, by sliding during its early contact, allows an approximately progressive start-up. It is evident that such a type of actions cause several drawbacks.

The outer rim of the pulley, made from a non-metallic material, as well as the contact surfaces of the pulley keyed on the drive shaft and of the pulley keyed on the shaft of the fluted roll undergo abrasion, and changes in their surface characteristics, due to the effect of the relative sliding, and of the local heating, which repeatedly occur at each start-up. The above affects the friction coefficient, which undergoes changes over time, not securing evenness and constancy in results.

Devices with clutch coupling are known as well, which also show the same drawbacks as mentioned, due to the effect of a not constant friction coefficient, whose changes over time cannot be controlled.

Devices are known as well, for starting-up motors for individual fluted drive rolls by means of the phase partialization technique, but the acceleration slopes and the deceleration slopes, during the various operating steps, cannot be regulated within wide limits, because they are tied to the frequency of the power supply voltages, and largely depend on the inertia of the load to be accelerated, which, in case of cone formation, varies between a minimum value, at cone winding beginning, up to a maximum value, corresponding to the winding end on full cone.

The present invention makes it possible to solve the above drawbacks, eliminating the damages caused to the collected thread during the whole winding process, and is furthermore also able to prevent any faults from arising in thread layers or positions, allowing a precision collection to be carried out, which is characterized by optimum unwinding properties.

A compact thread make-up is thus obtained, which is characterized by outstanding unwinding properties, free from overlapping defects, and suitable for all uses in the manufacturing processes downstream the coning.

These operative advantages are obtained, according to the present invention, thanks to the fact that the device of the invention makes it possible to conform the acceleration slope to the dynamic behaviour of cone-drive roll system. The cone is started up at each rewinding beginning, without slippings, independently on the diameter of the thread package, which increases until the desired size, as required by the production process, is reached.

The device of the present invention makes it possible as well to control also the deceleration ramp of the cone in contact with the drive roll, preventing that slippings may arise, in order not to have disarrangements in the turns, or localized scorchings in the fibrils of the collected thread.

In this connection, systems are known, which make it possible for the fluted drive roll to be braked by using block- or disk-brakes.

Both of them are systems dissipating the kinetic energy stored inside the running elements. Said energy is dissipated as heat. In these solutions too, the friction coefficient is not constant over time, nor can it be regulated, to obtain precise braking slopes, necessary to prevent the above mentioned damages from occurring.

None of the devices proposed by the prior art, together with those as above listed, have succeeded in totally eliminating the causes which determine the damaging, and the occurrence of the faulty thread layers or positions during the deceleration step. Nor are such operating systems capable of recovering the kinetic energy lost whenever the thread package decelerates, i.e., a change in speed froma given speed to a lower speed. Such deceleration can occur for example during the braking step. Energy saving was never taken into consideration as a determining element in the importance of the technical options in the field of use of the device of the present invention. The extent of the energy saving which is obtained by using the device of the present invention is such to awaken the users on this subject and on this technique, which allows, together with considerable operations savings, also technically simpler and functionally better solutions to be obtained.

By the proposal of the present invention, a considerable simplifying in the transmission members is in fact achieved, and the automation of the winding station is considerably favoured. Both the drive means, and the motor of each individual collection station do not require any routine maintenance, and can be suitably housed, thus contributing to the compactness of the coning head, and therefore of the whole operating front of the coner machine. The three-phase motor is known to have a sturdy structure, it is free from mechanical contacts, and, furthermore, requires a negligible servicing. The elimination of transmission pulleys, belts and shafts, and the like, reduces the machine stops for repairs, and simplifies the problems of the maintenance service.

By the proposal of the present invention, the possibility is achieved as well, of quickly and easily pre-establishing, by a digital action, the winding speeds in the collection stations, to conform them, from time to time, to the quality of the materials being processed, with the reduction of the wastes and increases in productivity. With the device of the present invention, automatic cycles for each individual coning station, or for groups of coning stations, or for the whole number of coning stations of the whole operating front can be introduced as well.

By the present invention, a number of considerable advantages are obtained as well.

The device according to the ivnention makes it possible, in fact, to achieve a working speed for each individual winding station, which is variable from station to station, and with the possibility of comparably precise and fast regulations. It makes it possible the steady-state running speed to be maintained cosntantly equal to the pre-established value, which can be calibrated by using a speed-monitoring probe-wheel keyed on the drive shaft, and which can perform an action on the drive force transmission path. Furthermore, the regulation impulses exert their influence on the cone winding speeds in real time; in such a way, the regulating circuit operates in a comparably fast way, and can therefore tend to a correct regulation.

The device maintains the speed of the drive roll constant within narrow limits, and makes it possible as well a perfect repeatibility over time to be accomplished in the acceleration slopes according to pre-established and calibratable values, such as not to cause slippings between the drive roll and the cone, whichever the size of this latter is, between the winding beginning and the winding end.

The precision of the variable-frequency inverter in accomplishing the pre-established speed is, per se, very high; it is therefore unnecessary to prefer the use of such speed sensor devices as speedometer dynamos, and the like, to accomplish a closed feed-back loop which increases the precision in the steady-state speed, in the acceleration slopes, and increases the operating reliability.

Those skilled in the art have generally acknowledged that the cause determining the damaging of the thread, and faulty windings, has to be largely sought in the not-controlled accelerations at the time of collection station re-start-up. Winding is stopped and must be restarted in the following situations: (1) when the thread breaks and knotting is required; (2) when the underlying pirn from which the thread is reeled off has to be changed because of thread consumption; and (3) when the cone on which the thread has been wound is to be changed because of the termination of winding. More or less marked slippings have a negative influence on the quality of the wound thread, because, for example, the slipping modifies the thread structure, rendering it of unreliable strength, or, in an extreme case, causing local scorchings.

The device of the present invention makes it possible as well to regulate the speed for each winding station; or it makes it possible to regulate the speed to equal values for a partial or total number of winding stations, along the whole machine operating front, to increase the flexibility of the production process, with no need of use of mechanical actions, such as belt changes, pulley changes, and the like. All of the speed levels can be digitally pre-established and are calibratable, by simple and fast procedures. The device makes it possible as well a uniformity in the start-ups and in the collection speeds between the various winding stations, and at different diameters of the cone being wound. All the above enables the user to achieve better slub catching qualities, with the slub catching being calibrated on coning parameters constant with time.

The variable-frequency inverter conforms always the power to the load, even during the start-up step.

Even disregarding the above advantages, which derive already from the conception of the invention as such, by the proposed device also a full set of other advantages are obtained.

The reversal of the motor running direction is performed without the use of contactors, by simply varying, at the level of electronic logic, the order of generation of the phases.

The electrical braking of the motor is performed, and both fast and gradual speed changes are accomplished, according to the requirements of the production cycle.

During the braking step energy is recovered on all of the winding stations undergoing deceleration, with said energy being partially or totally used on the other winding stations of the operating front, which are not in a braking step. The recovery of the braking energy by means of connections and electronic devices is made possible by the power generating effect of a three-phase motor running at supersynchronous speed.

The three-phase drive source feeds, through a variable-frequency inverter, the direct-current power supply line, with an electric power equal to the recovered kinetic energy less the various losses, these latter being of limited amount.

The trend of this instantaneous power fed depends on the trend of the braking over time. The power which is recoverable is that of the working units which are involved in the braking phase. From this power, only the amount corresponding to that consumed by the remaining units which are in the winding phase can be recovered. The excess power, if any, can be dissipated by resistors. Preferably, the excess power can be transferred to the three-phase line, to be used for other purposes inside the factory, an integral energy recovery being thus achieved.

The equipment of the present invention makes it possible, as above said, precise drives of the cone under formation to be obtained, which favour the automation of the winding station, in that the motion transmission members, as a whole, are simplified. This all can be understood by simply considering the elimination of the block- or disk-brake, and the elimiation of the mechanical motion reversing device, which are replaced by electronic devices, whose precision is higher. In this way, a uniformity is obtained in the controls, as a whole and in the operating areas of the collection stations, and, furthermore, considerable savings in stop and start-up times, frequently present throughout the cone formation cycle, are achieved.

A further advantage of the device of the present invention is the elimination of the noisiness of the motion-transmitting mechanical elements, such as the clutch wheels. These latter increase their eccentricity with time, generating vibrational phenomena which, in their turn, cause a noisy running of the machine, because the sound levels overlap to each other, and increase in ampltiude, endangering the health of the attending workmen.

With the device of the present invention, the possibility can be obtained as well, of disengaging the knotting cycle from the braking of the cone and of the roll.

In fact, by detecting, by means of the probe-wheel, the revolving speed of the roll; and by knowing, as well, through said probe-wheel, the length of thread already wound on the cone, and, consequently, the diameter of same come, by properly correlating such data, the value of the kinetic energy of the cone can be computed. It becomes thus possible, after a breakage of the thread being coned, or as a consequence of the cutting of the slubs, to disengage the braking of the cone and of the roll from the mechanical knotting cycle, for example, by making the braking action begin in advance relatively to the knotting cycle, by a time which is a function of the kinetic energy of the cone.

The present device consists of an electrical drive unit for driving and controlling the motion steps of the whole automatic cycle in the cross winding of threads on axial-symmetrical cone-frustum or cylindrical elements, on winding machines, characterized in that it comprises, in cooperation and coordination:

a three-phase drive source driving the individual collection station of a winding machine, such as an automatic coner machine;

a variable-frequency inverter which feeds and pilots the drive source, to render it suitable for performing precise acceleration, synchronization and braking functions at the various production speeds, and to conform, instant by instant, during the whole collection cycle, the power to the variable load depending on the size of the cone being formed;

a probe-wheel for speed monitoring, keyed on the drive shaft, and prearranged to be capable of measuring the speed and the length of the thread being collected on the cone being formed;

a fully-reversible power circuit capable of making electric power flow, during the braking step, from any motion source towards the other motion sources of the machine front (the zone in front of the machine and along the entire machine, considered in the direction along which the various adjacent winding units follow each other), or towards the electric power supply distribution system, to achieve such an energy recovery as to appreciably contribute to the increase in machine efficiency.

Thus, the traditional dissipative systems are eliminated.

In the following a preferred form of practical embodiment of the device according to the present invention is disclosed for exemplifying, non limitative purposes, with the aid of the hereto attached drawing tables, wherein.

Figure 1:
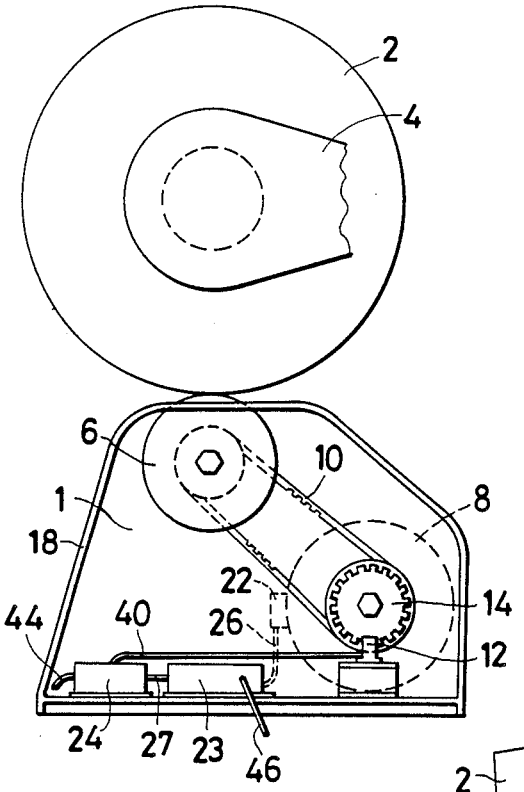
FIG. 1 shows a partially schematic, sectioal side view of the device of the invention, with the presence of the cone being formed, and the cone-holder arm of a winding machine.
Figure 2:
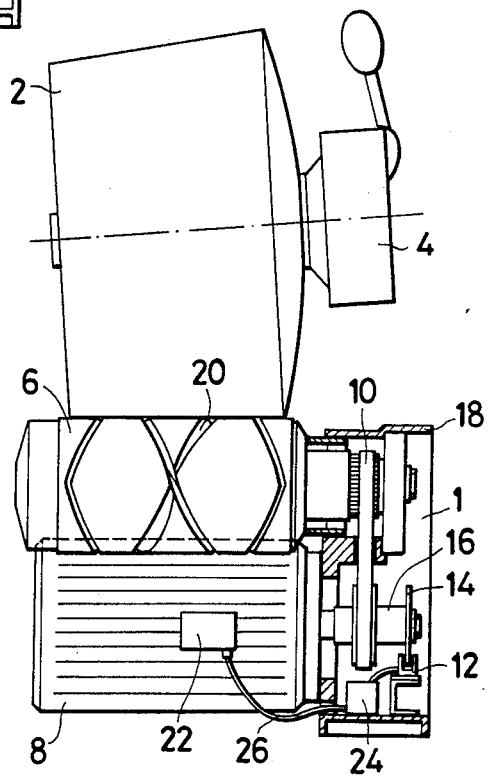
FIG. 2 shows a schematic, partially sectional, front view of the device according to the present invention, with the presence of the thread-guide drive roll, and of the cone under winding.
Figure 3:
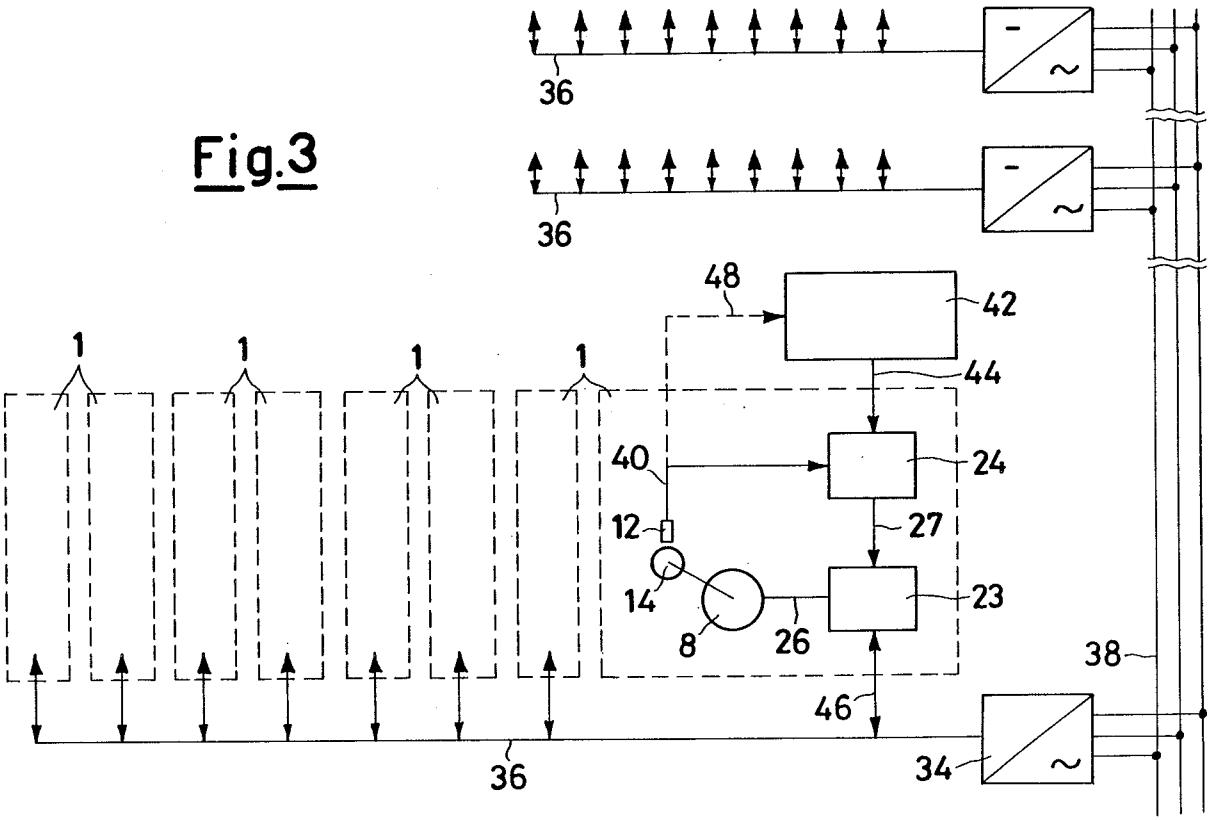
FIG. 3 shows the diagram of the operating units of the device according to the invention, and of their connection lines.
Figure 4:
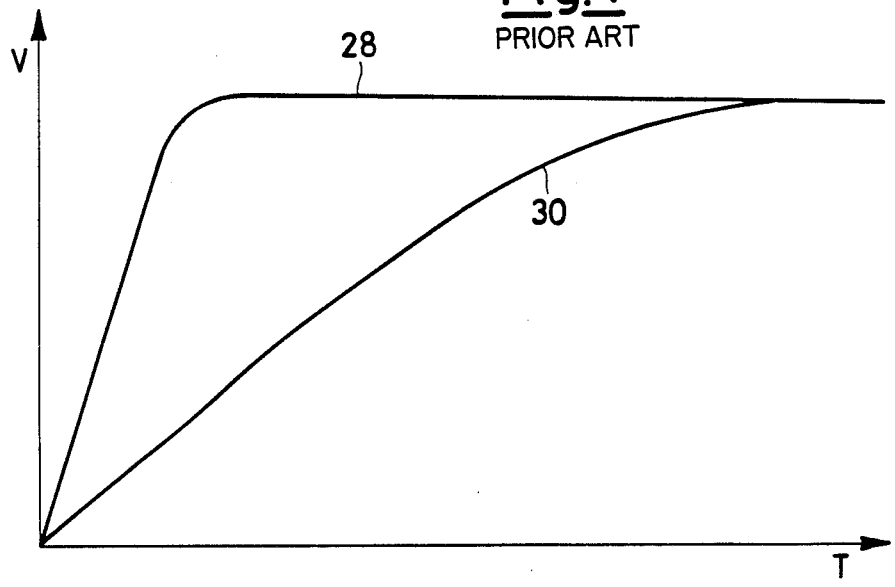
Fig.4 PRIOR ART
Figure 5:
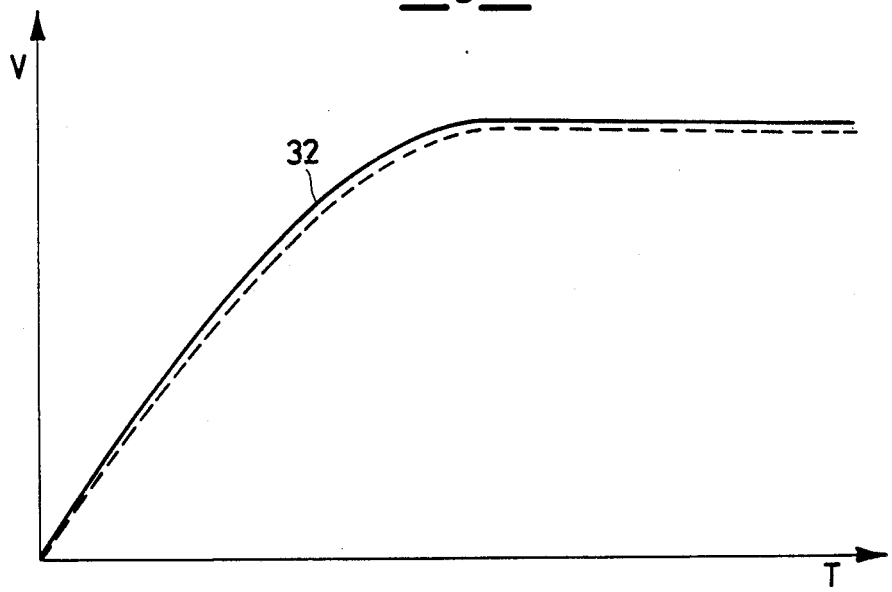

FIG. 4, supplied for comparison purposes, shows the characteristic motion curves, instant by instant, of the fluted drive roll, and of the driven cone during the start-up step from speed zero to the steady-state speed in the traditional coning system known from the prior art;

FIG. 5 shows the characteristic motion curves, instant by instant, of the fluted drive roll, and of the driven cone during the start-up step from speed zero to the steady-state speed in the coning system using the device of the present invention.

In the figures, same elements, or elements performing a same function, are indicated by the same reference numerals.

In the figures: 8 is a three-phase drive source provided to drive the individual winding station; 1 is the individual winding station; 6 is the drive roll, which supplies both the shift of the reciprocating movement of the thread, and the revolution motion of the cone 2 under formation, until the desired diameter of the thread package is obtained; 10 is the toothed belt provided to accomplish a positive transmission between the drive shaft 16 and the thread-guide roll 6; 2 is the cross-wound cone under formation; 4 is the cone-holder arm, which supports the thread package 2 as the diameter thereof increases; 12 is the probe cooperating with the wheel 14 to monitor the speed during the whole cycle of cone formation; 14 is the wheel keyed on the drive shaft 16, which, in cooperation with the probe 12 sends, instant by instant, the speed monitoring data, to the central unit 24; 16 is the drive shaft on which the pulley driving the toothed belt 10 is keyed; 18 is the upper support of the individual winding station; 20 are the helical grooves, whose inclination angle corresponds to the crossing helical turns formed by the thread on cone 2; 22 is the box of the terminal box of the three-phase drive source 8, to which electric power is supplied by the cable 26 coming from the variable-frequencey inverter 23; 23 is a variable-frequency inverter which feeds and pilots the drive source 8; 24 is the central control unit, which processes the operating parameters, correlating them to the data supplied by the probe-wheel 12 and 14; 26 is the cable connecting the variable-frequency inverter 23 with the three-phase drive source 8; 27 is the cable connecting the central control unit 24 with the variable-frequency inverter 23; 44 is the cable connecting the central control unit 24 with the unit 42 containing in its storage memory the pre-established logic of the whole operating cycle of the winding station; 46 is the cable connecting the variable-frequency inverter 23 with the direct-current electric line 36 running along the whole winding machine; 34 is the power supply unit inserted between the external alternating-current line 38 and the direct-current line 36; 36 is the direct-current line; 38 is the external power-supply three-phase, alternating-current line; 40 is the cable for connection of the probe 12, which cooperates with the wheel 14 to monitor the speed, with the central control unit 24; 42 is the unit wherein the pre-established logic of the whole operating cycle of the winding station is stored; 48 is the cable connecting the probe 12 cooperating to monitor the speed, with the unit 42 wherein the pre-established logic of the whole cone-formation cycle is stored; 28 is the characteristic motion curve, supplied for comparative purposes, during the start-up step of the thread-guide fluted drive roll 6, which accelerates from initial speed zero to the steady-state speed, according to a strongly inclined acceleration slope. Said chart 28 relates to a traditional winding with clutch-drive, as hereinabove mentioned; 30 is the characteristic motion curve of the cone 2 friction-driven by the drive roll 6 during the start-up step, with an acceleration slope less inclined than the acceleration slope of the curve 28, relating to the drive roll 6.

The differences in behaviour derive from the unavoidable slippings between the drive roll 6 and the driven cone 2 along their contact line, during the traditional cone-forming winding; 32 is the characteristic motion curve of the drive roll 6, which overlaps to, and hence coincides with the characteristic motion curve of the driven cone 2 during the start-up step from zero speed to its steady-state speed in the cone-forming winding system using the device according to the present invention.

The device operates as follows.

Under conditions of thread-guide drive roll 6 stationary, in the rest position, the three-phase drive source 8 is mechanically stationary, and does not receive electrical power from the cable 26 of connection with the variable-frequency inverter 23.

On the power-supply, direct-current electrical line 36, which runs along the whole operating front to supply electrical power to the winding positions, the feed voltage is present.

When the operation of the thread-guide drive roll 6 is requested, to start the winding, the following actions take place: through the connection cable 44 by the unit 42, containing stored in its storage memory the pre-established logic of the whole operating cycle, the signals of pre-selection of the accelerations and speeds which the user wants to obtain, instant by instant, during the whole operative winding cycle, are sent to the central control unit 24; at a desired time, from the unit 42 to the central unit 24 the operation start-up signal is sent. The central control unit 24 sends, as a function of the pre-selection signals, to the variable-frequency inverter 23, through the connecting line 27, the signals of winding station 1 actuation start-up. The variable-frequency inverter 23 draws electrical power from the direct-current electrical line 36 through the connection cable 46, to feed the three-phase drive source 8 through the connection cable 26.

The drive source 8 starts to revolve, during the probe-cooperating wheel 14 to revolve, and, through the toothed belt 10, drives to revolve the thread-guide fluted roll 6 too. The speed monitoring probe 12, in cooperation with the wheel 14 supplies to the central control unti 24, through the connection cable 40, instant by instant, the instant speed values.

The central control unit 24 compares the pre-selection signal sent to the unit 42, to the value of the instant speed sent by the probe 12 and, by suitable processings, supplies to the variable-frequency inverter 23, through the connection cable 27, a new corrected drive signal. The variable-frequency inverter 23, continuously conforming itself to the received signals, feeds and pilots, instant by instant, the three-phase drive source 8. In this way, it is possible to precisely follow pre-established acceleration curves and it is possible as well to maintain the value of the reached steady-state winding speed, it too being pre-established, within a prefixed range, independently from the applied loads; these latter being continuously variable during the whole winding cycle for the formation of a cone 2. During the acceleration steps, from the direct-current electrical line 36 a power is demanded and absorbed, which is larger than the demanded and absorbed power during the steady-state-speed winding process.

Said acceleration power is stored as kinetic energy in the revolving parts. When to the unit 42 a signal is enabled, which indicates the need of a braking cycle, it sends to the central control unit 24, through the connection cable 44, signals of preselection of the pre-established deceleration; at the desired time, a braking-step-start-up signal is enabled to the central control unit 24, which sends to the variable-frequency inverter 23, through the connection cable 27, the actuation signals.

During this braking time, the variable-frequency inverter 23 behaves such to transfer the electrical power, this latter from the drive source 8, which assumes the function of a generator actuated by the kinetic energy stored by the moving members, from the same drive source 8 to the direct-current electrical line 36 through the following elements: the connection cable 26, the variable-frequency inverter 23, and the connection cable 46. In that case, the direct-current electrical line 36 has available a power not coming from the power supply unit 34. Such power can be collected and used by the other winding stations 1 connected to the same direct-current electrical line 36, thus an energy recovery—and hence an energy saving—being obtained.

If the energy recovered, and transferred to the electrical line 36 exceeds the demand by the other collection stations 1 which are in their winding step, the energy excess can be transferred, through the power supply unit 34, to the external power supply three-phase line 38, or it can be dissipated through resistors provided inside the variable-frequency inverter 23. During the time during which the thread-guide fluted roll 6 is driven, the signal generated, instant by instant, by the speed-monitoring probe 12, is sent, through the connection cable 48, to the unit 42 of the winding station 1, which processes it in order to compute the information of winding speed, and of length of thread wound on the cone 2 under formation.

Herein, a preferred form of practical embodiment has been disclosed, together with some variants thereof. It is anyway evident that other forms of practical embodiment are possible, which fall inside the spirit and the scope of the present invention.

Thus, the layouts of the drive means may vary; it is possible as well to couple, or to remove operating units on the individual winding station, or on a plurality of winding stations, in order to advantageously coordinate the whole set of the units in the various actuation and control steps.

These and still other variants are therefore possible without thereby exiting the scope of the invention.

We claim:

1. Apparatus for regulating the rotation of a thread guide roll in a winding station comprising:

(a) a rotatable drive source operatively coupled to the thread guide roll, wherein rotation of the drive source rotates the thread guide roll;

(b) inverter means coupled to the drive source for supplying variable frequency alternating current electrical power to the drive source;

(c) control means coupled to the inverter means for varying the frequency of the current supplied by the inverter means to the drive source for thereby alternately accelerating and decelerating the drive source;

(d) a power supply; and (e) circuit means interconnecting the power supply and the drive source for delivering to the power supply at least a portion of the electrical power available from the drive source due to generation of back electromotive force during deceleration of the drive source.

2. The apparatus according to claim 1, wherein the thread guide roll is fluted.

3. The apparatus according to claim 1 further comprising a toothed belt coupled to the thread guide roll and to the drive source.

4. The apparatus according to claim 1, wherein the drive source is a three-phase drive source.

5. The apparatus according to claim 1, wherein the inverter means is a variable frequency inverter.

6. The apparatus according to claim 1, wherein the control means comprises:

(i) a central control unit; and (ii) monitoring means operatively coupled to the drive source and to the central control unit to monitor the rotation speed of the drive source and to send the detected value to the central control unit for processing.

7. The apparatus according to claim 6, wherein the monitoring means comprises a wheel mounted on the drive shaft of the drive source and a probe operatively coupled to the wheel and connected to the central control unit.

8. A method for regulating the rotation of a thread guide roll in a winding station comprising:

(a) coupling a rotatable drive source to the thread guide roll such that rotation of the drive source rotates the thread guide roll;

(b) coupling a variable frequency inverter to the drive source for supplying variable alternating current electrical power to the drive source;

(c) monitoring the rotation speed of the drive source by a monitoring unit coupled to the drive source;

(d) sending the detected rotation speed of the drive source to a central control unit which compares the detected rotation speed with preestablished parameters;

(e) increasing and decreasing the frequency of the alternating current supplied by the inverter to the drive source to thereby alternately accelerate and decelerate the drive source; and (f) delivering to the power supply at least a portion of the electrical power available from the drive source due to generation of back electromotive force during deceleration of the drive source.

* * * * *